US008770579B2

(12) United States Patent
Takeshita et al.

(10) Patent No.: US 8,770,579 B2
(45) Date of Patent: Jul. 8, 2014

(54) RECORDING APPARATUS

(75) Inventors: Sanshiro Takeshita, Nagano-ken (JP); Takehiko Saito, Nagano-ken (JP); Hidenao Suzuki, Nagano-ken (JP); Hiroyuki Yoda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 242 days.

(21) Appl. No.: 13/360,871

(22) Filed: Jan. 30, 2012

(65) Prior Publication Data

US 2012/0193865 A1 Aug. 2, 2012

(30) Foreign Application Priority Data

Jan. 31, 2011 (JP) ..... 2011-017962

(51) Int. Cl.
*B65H 29/66* (2006.01)

(52) U.S. Cl.
USPC ..... 271/216; 271/212

(58) Field of Classification Search
USPC ..... 271/207, 212, 216
See application file for complete search history.

(56) References Cited

U.S. PATENT DOCUMENTS

| | | | | | |
|---|---|---|---|---|---|
| 3,704,793 | A * | 12/1972 | Nicol et al. | ..... | 271/178 |
| 4,141,546 | A * | 2/1979 | Queener | ..... | 271/288 |
| 5,653,437 | A * | 8/1997 | Inoue et al. | ..... | 271/178 |
| 7,513,498 | B2 * | 4/2009 | Elenes et al. | ..... | 271/178 |
| 2006/0083564 | A1 | 4/2006 | Yazawa et al. | | |
| 2011/0233858 | A1 * | 9/2011 | Uchiyama et al. | ..... | 271/234 |

FOREIGN PATENT DOCUMENTS

| | | | | |
|---|---|---|---|---|
| JP | 01008179 A * | 1/1989 | ..... | B65H 33/08 |
| JP | 2006205655 | 8/2006 | | |

* cited by examiner

*Primary Examiner* — Prasad Gokhale

(57) ABSTRACT

A recording apparatus includes a holding unit that holds a recorded recording medium in a standing posture, a roller that sends the recording medium to the holding unit, and a restricting unit that restricts the position of the recording medium not to be in contact with the roller.

5 Claims, 7 Drawing Sheets

RECORDING APPARATUS

BACKGROUND

1. Technical Field

The present invention relates to a recording apparatus that holds a recording medium where predetermined recording is performed in a standing posture.

2. Related Art

A vertical type of recording apparatus has been known in the art (see JP-A-2006-205655), which includes a holding unit (discharge stack) that holds a recording medium (recording sheet) in a standing posture, which is transported from a recording sheet receiving unit, which can receive the recording medium in a standing state and where recording is finished, and a discharge roller that is disposed around the holding unit, at the end of a transporting path by which the recorded recording medium is transported.

In the vertical type of recording apparatus of the related art, the recording medium stacked in a standing posture in the holding unit may come in contact with the discharge roller when the lower end is bent or separated from the holding unit. Since the surface of the discharge roller is usually made of rubber, the recording medium is contaminated or damaged when the recording medium on the holding unit is in contact with the discharge roller. Further, when the discharge roller is rotated backward with the recording medium, which is separated from the holding unit, in contact with the discharge roller, paper jam may be caused.

SUMMARY

An advantage of some aspects of the invention is to provide a recording medium that can appropriately prevent a recording medium that is held after recording from coming in contact with a discharge roller that transports the recording medium.

According to an aspect of the invention, there is provided a recording apparatus including: a holding unit that holds a recorded recording medium in a standing posture; a roller that sends the recording medium to the holding unit; and a restricting unit that restricts the position of the recording medium not to be in contact with the roller.

According to the configuration, the recording medium sent by the roller is received in the receiving unit, with the position restricted not to be in contact with the roller. Therefore, it is possible to prevent the recording medium discharged and held after recording from coming in contact again with the roller. Accordingly, it is possible to appropriately prevent the recorded recording medium from being contaminated or damaged, which occurs when the recording medium comes in contact with the discharge roller.

In the recording apparatus, the bottom of the holding unit may be positioned vertically lower than the top of the roller.

According to the configuration, since the bottom of the holding unit is positioned lower than the top of the roller (the uppermost point in the vertical direction), the roller does not interfere with sending of the recording medium.

In the recording apparatus, a medium intake portion that delivers the recording medium sent across the top of the roller to the holding unit may be formed at the upper end of the restricting unit.

In the recording apparatus, the medium intake portion may be positioned vertically lower than the top of the roller.

According to this configuration, the recording medium sent to the roller is delivered from the roller to the medium intake portion and then smoothly sent to the receiving unit along the medium intake portion. In particular, as the medium intake portion is disposed lower than the roller, it does not interfere with sending of the recording medium and the recording medium is surely received in the receiving unit.

In the recording apparatus, the bottom of the holding unit may be disposed to decline away from the roller.

According to the configuration, the sent recording medium automatically follows the bottom of the holding unit by the own weight. Therefore, the lower end of the recording medium is held in non-contact with the roller.

The recording apparatus may further include a recording medium cassette that is attachable/detachable to/from a case equipped with the roller and receives the recording medium in a standing posture, in which the holding unit is disposed in the recording medium cassette.

According to the configuration, as the recording medium cassette is separated from the case (recording apparatus), it is possible to concurrently supply a non-recorded recording medium and take out a recorded recording medium. Further, since the holding unit is disposed in the recording medium cassette, it is possible to remove a specific configuration for holding the recording medium and it is also possible to simplify the structure and reduce the cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to a first embodiment of the invention is described with reference to the accompanying drawings. The recording apparatus performs desired recording while transporting a sheet (recording medium) held in a standing posture, and holds (stocks) the recorded sheet, which is discharged, in a standing posture. Further, an X-axial (lateral) direction, a Y-axial (front-rear) direction, and a Z-axial (vertical) direction are determined, as shown in the figures, which are described below.

Figure 1:
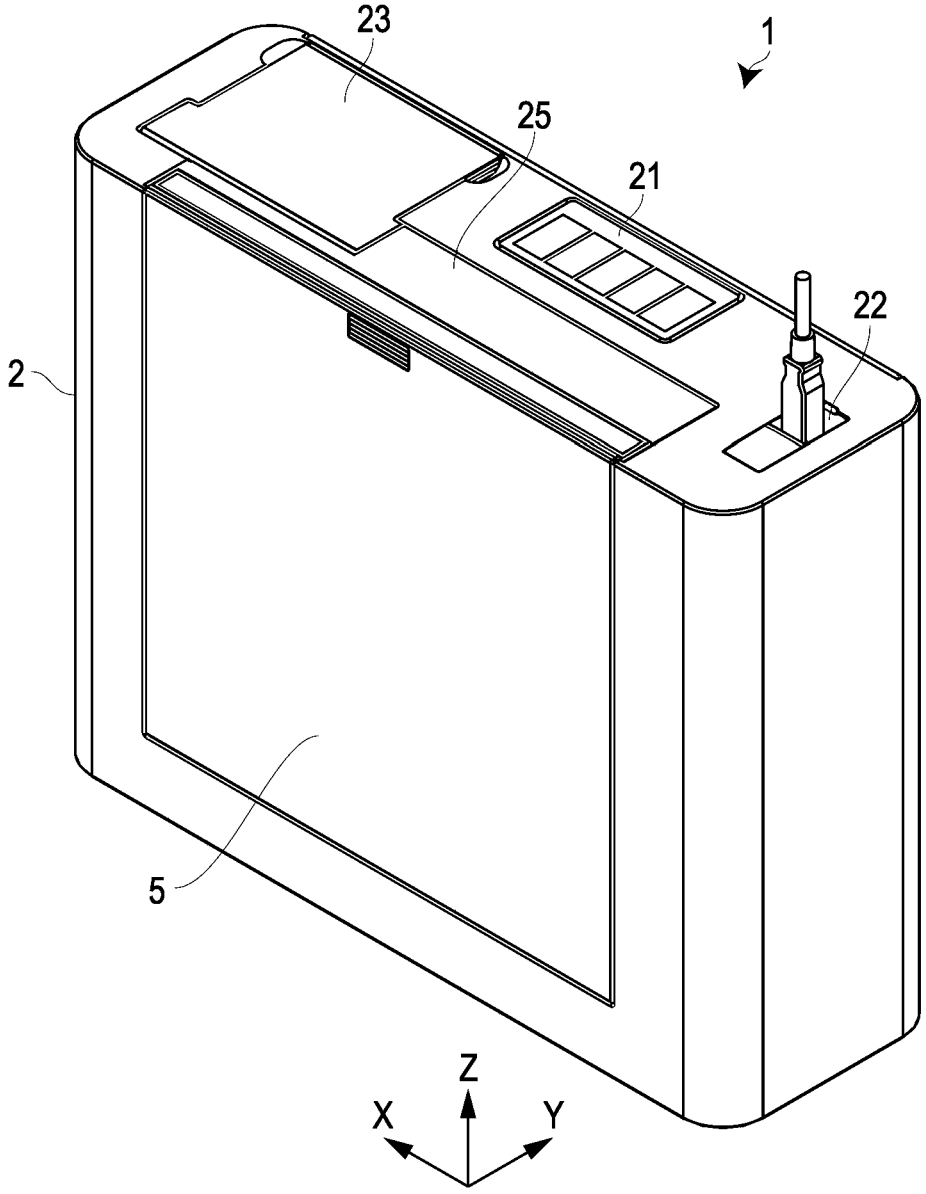
FIG. 1 is a perspective view showing the external appearance of a recording apparatus.
Figure 2:
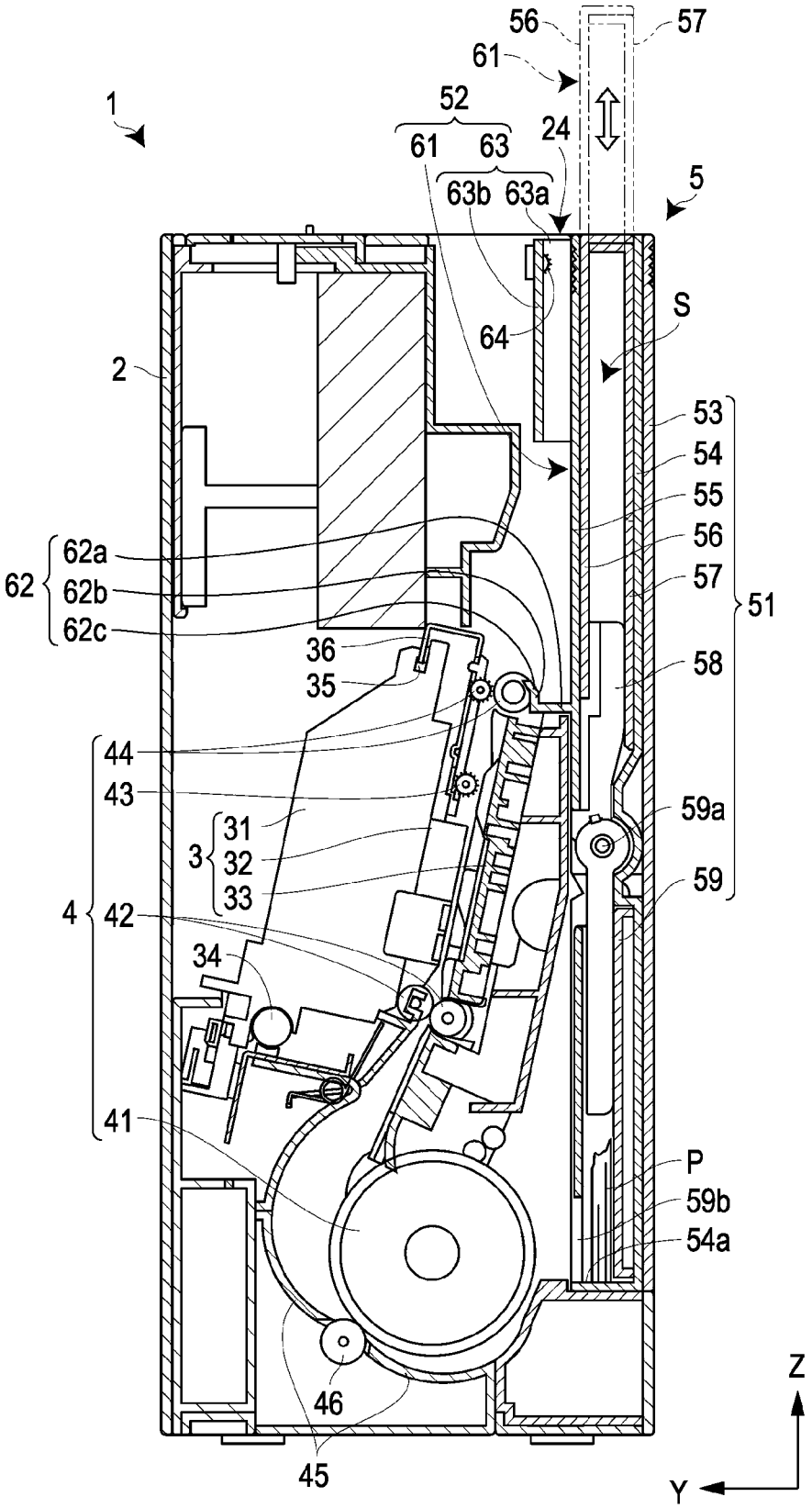
FIG. 2 is a side cross-sectional view of the recording apparatus with a sheet spaced apart from a feed roller.

As shown in FIG. 1 or FIG. 2, a recording apparatus 1 has the external appearance composed of a case 2 having thin box shapes with a Z-axial dimension larger than the X-axial and Y-axial dimensions. Further, the recording apparatus 1 includes a printing unit 3 that performs ink jet type printing on a sheet P placed on a transporting path, a transporting unit 4 that transports the sheets P along the transporting path, a recording medium cassette 5 that is detachably mounted on the case 2 to receive the sheet P in a standing posture, and an apparatus frame (not shown) that supports the transporting unit 4 or the printing unit 3.

An operation panel 21 with operation buttons and the like, a cable terminal 22 where a cable for connection to a PC or the like, and a cartridge cover 23 that opens/closes a cartridge mounting portion (not shown) where a plurality of ink cartridges (not shown) is detachably mounted are formed on the upper surface of the case 2. Further, a sheet outlet cover 25 that opens/closes a sheet outlet 24 for discharging a recorded sheet P (recording medium) is disposed on the upper surface of the case 2. Further, the sheet outlet cover 25 is opened/closed by a user, but is also automatically opened by an opening/closing mechanism (not shown) if recording is performed with the sheet outlet cover closed.

The printing unit 3 is disposed downstream further than a pair of transporting rollers 42, which is described below, and includes a carriage 31 equipped with an ink jet head 32 and a guide member 33 disposed opposite the ink jet head 32.

The carriage 31 can be reciprocated by a motor (not shown) along a carriage guide shaft 34 extending in the X-axial direction. Further, as shown in FIG. 2, the carriage 31 is disposed at an angle, such that a force for rotation about the carriage guide shaft 34 is generated. A guided portion 35 disposed above the carriage 31 keeps the posture of the carriage 31, with a carriage guide plate 36, which extends in the X-axial direction, therebetween.

A guide member 33 constitutes a portion of the transporting path and defines a gap (work gap) between the recording surface of the sheet P and the ink jet head 32. Further, the guide member 33 has a concave-convex portion receiving ink discharged to a region deviated from the end of the sheet P when no-margin printing is performed at a position opposite to the ink jet head 32. An ink suctioning member (not shown) that suctions ink is disposed at the center of the concave-convex portion. Further, a wasted liquid tank (not shown) storing wasted ink is disposed under the guide member 33.

Further, a so-called off-type carriage in which the ink cartridge is disposed independently from the carriage 31 is exemplified in the embodiment, but an on-type carriage in which an ink cartridge is mounted on the carriage 31 may be used. Further, although a so-called serial printer that performs recording while moving the carriage 31 in the X-axial direction is exemplified in the embodiment, but a fixed-type of ink jet head 32 that covers the width of the sheet P may be used. Further, the invention is not limited to the ink jet type and other recording types may be used.

The transporting unit 4 includes, from the upstream side, a feeding roller 41 that is disposed opposite the front end of the mounted recording medium cassette 5 and sending the sheet P downstream which is supplied from the recording medium cassette 5, a pair of transporting rollers 42 transporting the sheet P to the printing unit 3, a guide roller 43 preventing the sheet P from floating from the guide member 33 of the printing unit 3, and a pair of discharge rollers 44 discharging the recorded sheet P from the printing unit 3. Further, the feed roller 41, the transporting rollers 42, the guide roller 43, and the discharge rollers 44 are disposed at a plurality of positions with appropriate intervals in the width direction (X-axial direction) of the sheets P.

The feed roller 41 discharges the sheet P downward while being rotated by a motor (not shown), in contact with the front end of the sheet P. A guide member 45 that forms a substantially U-shaped transporting path where the sheet P is returned is disposed opposite the outer circumferential surface of the feed roller 41. Further, reference numeral 46 indicates a sub-driven roller that assists discharging of the sheet P by the feed roller 41.

The sheet P discharged downward is turned upward by the feed roller 41 and the guide member 45 and sent to the pair of transporting rollers 42. The sheet P is interposed between the pair of transporting rollers 42 and sent to the printing unit 3. The sheet P where printing is performed by the printing unit 3 is discharged to a discharged sheet holding unit 52 (described below) of the recording medium cassette 5 through the guide roller 43 and the pair of discharge rollers 44.

Figure 3:
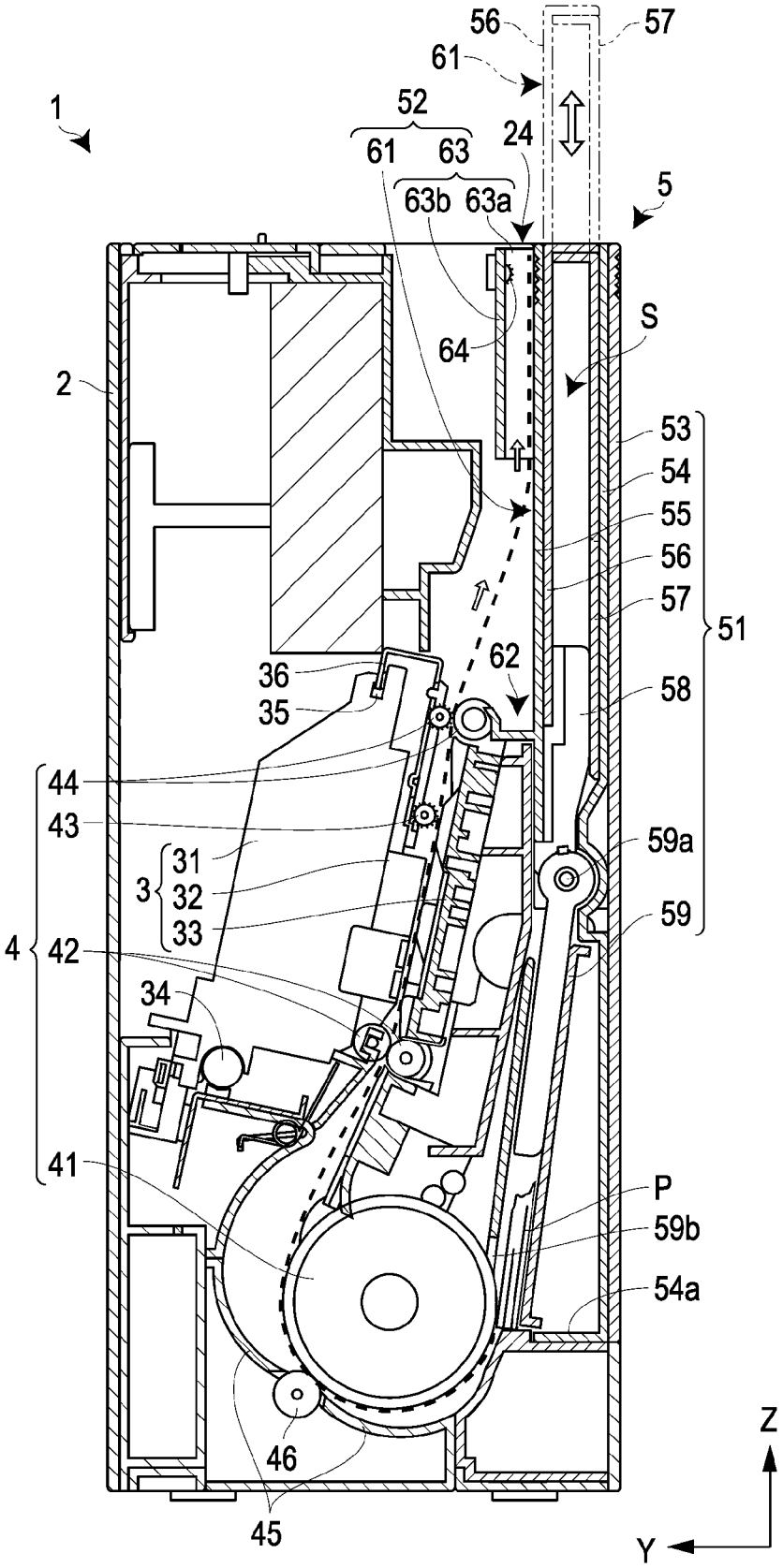
FIG. 3 is a side cross-sectional view of a recording apparatus with a sheet in pressure-contact with a feed roller.

As shown by a dotted-lines in FIG. 3, in the embodiment, the discharge direction of the sheet P by the discharge rollers 44 is set upward to the recording medium cassette 5 at an angle. The discharged sheet P is moved upward while sliding on a holding surface 61 (described below) of the recording medium cassette 5.

Further, in the embodiment, the feed roller 41 (and the sub-driven roller 46), the transporting rollers 42, and the discharge rollers 44 are nip rollers. Further, in the embodiment, the transporting roller 42 and the discharge roller 44 which are positioned at the guide member 33 are driven to rotate by motors (not shown) respectively, and the transporting roller 42, the guide roller 43, and the discharge roller 44 which are disposed at the ink jet head are driven, respectively. Further, the discharge roller 44 at the driving side is a rubber roller and the guide roller 43 and the discharge roller 44 spur-shaped rollers (star wheels).

Next, the recording medium cassette 5 is described in detail with reference to FIG. 2 to FIG. 5. The recording medium cassette 5 is attachable/detachable to/from the case 2 and the external appearance of the recording apparatus 1 is achieved when the recording medium cassette 5 is mounted. Further, the inside of the recording apparatus 1 is exposed by separating the recording medium cassette 5, such that it is possible to remove inconvenience, such as jam of the sheet P on the transporting path.

Further, though not shown, the recording medium cassette 5 can freely slide in the Z-axial direction with respect to the case 2 and the attachment/detachment is performed by sliding the recording medium cassette 5.

The recording medium cassette 5 includes a cassette main body 51 receiving the sheet P in a standing posture and a discharged sheet holding unit 52 disposed in the cassette main body 51 and holding the sheet P in a standing posture.

The cassette main body 51 includes a case body 53 that defines the schematic appearance of the recording apparatus 1 in surface contact with the case 2 when being mounted, a main body tray 54 that is formed in an overall tray shape, an upper outer cover 55 that opens/closes a sheet receiving space S for receiving the sheet P, an upper inner cover 56 that is slidably disposed to protrude from the upper end of the main body tray 54 with respect to the upper outer cover 55, an upper slide tray 57 that is slidably disposed to protrude from the upper end of the main body tray 54, in the main body tray 54, an edge guide 58 that is disposed slidably in the X-axial direction with respect to the upper outer cover 55, and a movable tray 59 that vibrates the front end of the sheet P received in the sheet receiving space S.

A sheet front end support wall **54*a* that supports the front end of the received sheet P is formed at the lower end of the main body tray 54. The sheet P received with the recording medium cassette 5 mounted is supported with the front end being in contact with the sheet front end support wall 54*a***.

Figure 5:
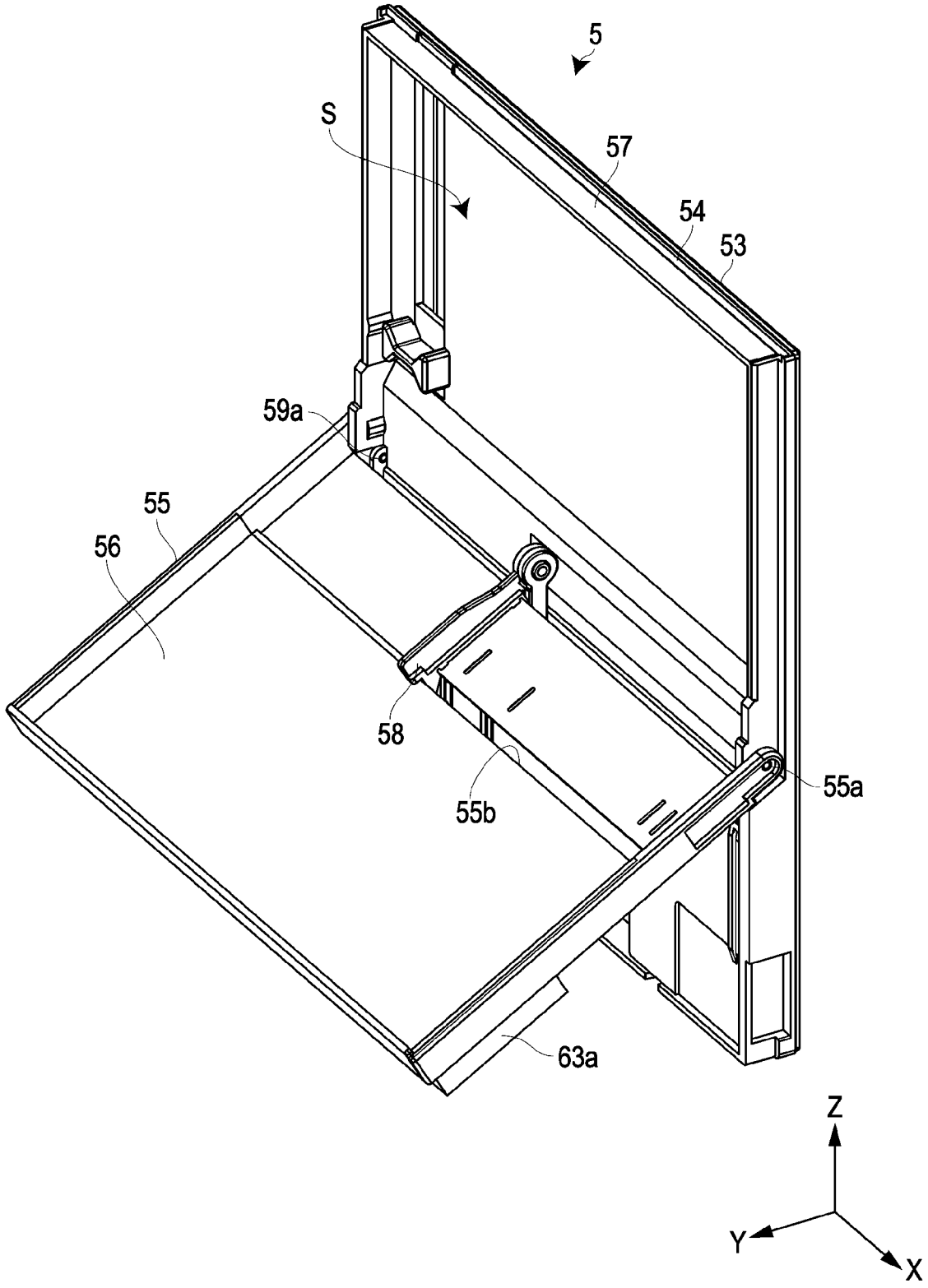
FIG. 5 is a perspective view showing when the upper outer cover of the recording medium cassette according to the first embodiment of the invention is open.

As shown in FIG. 5, the upper outer cover 55 rotates about a pair of left and right rotational points **55*a* disposed at a substantially vertical center portion of the main body tray 54**.

As the upper outer cover 55 is opened, the sheet receiving space S appears and the sheet p can be received.

Further, the outer surface of the upper outer cover 55, that is, the surface facing the inside of the apparatus when being mounted to the case 2 functions as a holding surface 61 for holding (storing) the recorded sheet P (described in detail below).

As shown in FIG. 2 and FIG. 3, the upper inner cover 56 is slidably disposed in the sending direction of the sheet P (Z-axial direction) with respect to the upper outer cover 55, with the recording medium cassette 5 mounted on the recording apparatus 1 (case 2). Further, similarly, the upper slide tray 57 is disposed slidably in the Z-axial direction with respect to the main body tray 54, with the recording medium cassette 5 mounted. It is possible to form the sheet receiving space S that is the most suitable for the sheet P by extending/contracting the upper inner cover 56 and the upper slide tray 57 to fit to the Z-axial direction of the sheet P.

Further, when the upper inner cover 56 is extended, the outer surface of the upper inner cover 56 extends to continue from the outer surface of the upper outer cover 55 and the holding surface 61 extends in the Z-axial direction.

Figure 4:
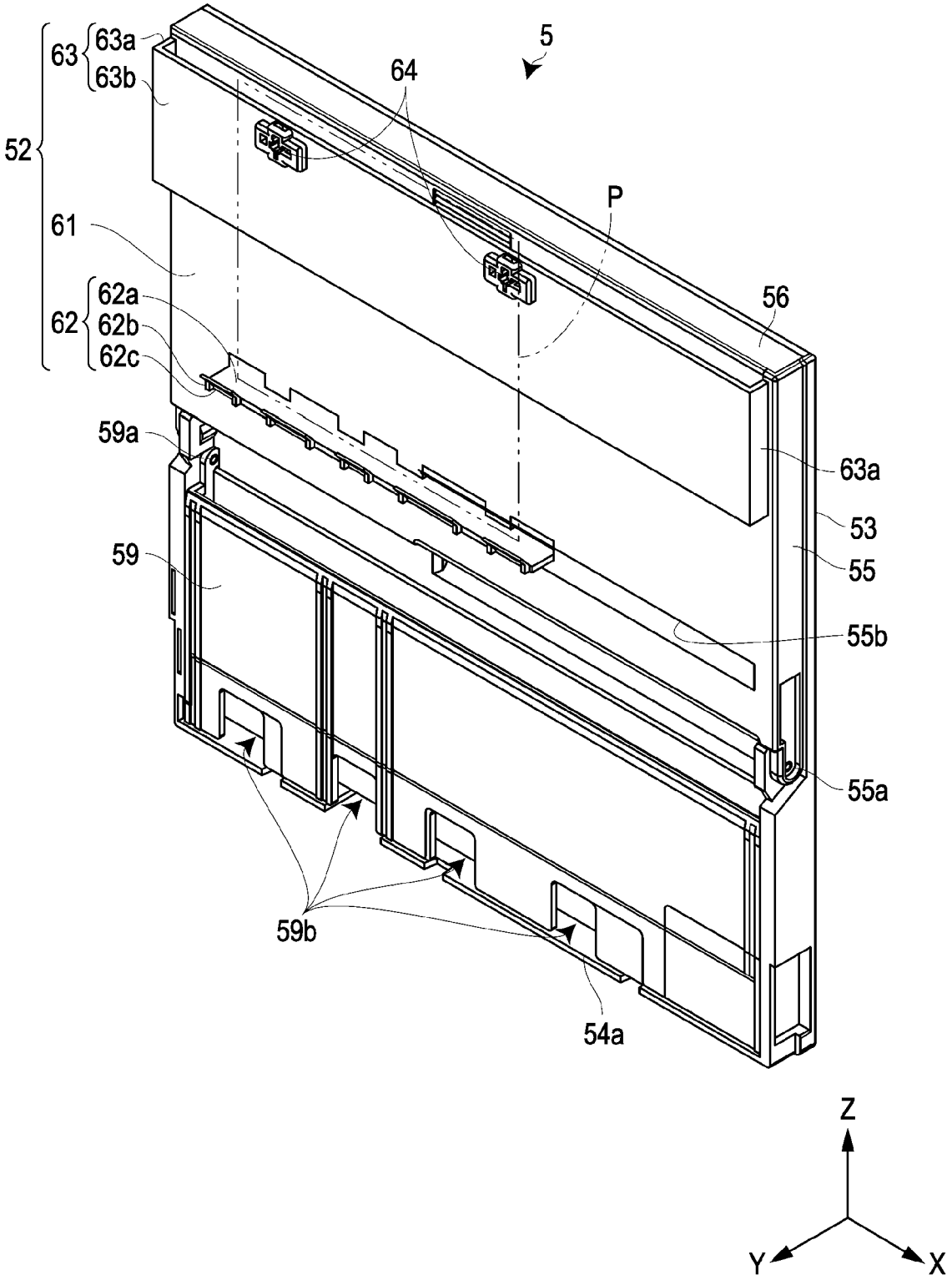
FIG. 4 is a perspective view of a recording medium cassette according to a first embodiment of the invention.

As shown in FIG. 4 and FIG. 5, the edge guide 58 is slidably fitted in a long hole 55*b* opened and extending in the X-axial direction at the upper outer cover 55 and is disposed slidably to fit to the width of the sheet P received in the sheet receiving space S. Accordingly, the edge of the set sheet P is guided to an appropriate position in accordance with the X-axial length (width) of the sheet P. Further, though not shown, the edge guide 58 is partially exposed to the outside of the upper outer cover 55 and it is possible to slide the edge guide 58 by operating the exposed portion even though the upper outer cover 55 is closed.

As shown in FIGS. 2 and 3, the movable tray 59 is disposed under the main body tray 54 at the downstream side in the sheet-sending direction, with the recording medium cassette 5 mounted, to function as a so-called hopper. The movable tray 59 can rotate about a pair of left and right vibration points 59*a* (see FIGS. 4 and 5) disposed at a substantially vertical center portion of the main body tray 54 and is vibrated by a driving mechanism (not shown). Accordingly, the front end of the received sheet P can be brought in pressure-contact with the feed roller 41 (see FIG. 3) and separated (see FIG. 2).

Further, as shown in FIG. 4, a plurality of contact openings 59*b* is formed with appropriate intervals in the X-axial direction, at the position corresponding to the sheet P, in the movable tray 59. The feed roller 41 can be pressure-contact with the received sheet P by the contact openings 59*b*.

Next, the discharged sheet holding unit 52 is described with reference to FIG. 2 and FIGS. 4 to 6B. The discharged sheet holding unit 52 includes a holding surface 61 formed by the outer surface of the upper outer cover 55 and the like, a receiving unit 62 receiving the lower end of the discharged sheet P and positioning the lower end of the received sheet P not to be in contact with the discharge holler 44, and a holder 63 disposed on the holding surface 61 and holding the sheet P in a standing posture.

The holding surface 61 is a substantially flat surface positioned from the periphery of the pair of discharge rollers 44 to a paper discharge port 24, when the recording medium cassette 5 is mounted on the case 2. Further, as described above, as the upper inner cover 56 extends, the holding surface 61 extending upward further than the paper discharge port 24. The sheet P discharged by the discharge rollers 44 moves toward the paper discharge port 24 while sliding on the holding surface 61. The sheet P is protruded and discharged upward from the paper discharge port 24 by the size of the sheet P.

As described above, the sheet receiving space S receiving a non-recorded sheet P and the holding surface 61 holding a recorded sheet P are formed on the front and back of the same member (the upper outer cover 55 and the upper inner cover 56). Accordingly, it is possible to fit to the size of the discharge side by making the feed side to the size of the sheet P. Further, since a portion (a surface) of the upper outer cover 55 (and the upper inner cover 56) functions as the holding surface 61 holding the sheet P, the configuration for maintaining the sheet P can be removed, such that is possible to simplify the structure and reduce the cost.

As shown in FIGS. 2 to 6A, the receiving unit 62 has a supporting portion 62*a* that protrudes to the discharge rollers 44 from the holding surface 61 and supports the lower end of the sheet P and a restricting portion 62*b* that is disposed upward at the front end of the supporting portion 62*a* and restricts the position of the lower end of the received sheet P. That is, the receiving unit 62*a* has an L-shape when seen from a side and is formed in a pocket shape by the holding surface 61, the supporting portion 62*a*, and the restricting portion 62*b*. Further, the "holding unit" in the aspect means the upper outer cover 55 and the holder 63 and the "roller" means the driving-side discharge roller 44.

The supporting portion 62*a* is a plate-shaped member that extends in the X-axial direction and protrudes horizontally in the Y-axial direction from the holding surface 61 (see FIG. 4). Further, the support portion 62*a* is positioned lower than the driving-side discharge roller (see FIG. 6A). That is, the sheet P sent by the discharge roller 44 is dropped from the top that is the uppermost point in the vertical direction of the discharge roller 44 by the own weight and the lower end is supported by the supporting portion 62*a*.

The restricting portion 62*b* is vertically disposed at the front end of the support portion 62*a* and disposed at a plurality of positions with appropriate intervals in the X-axial direction, interposed between the driving-side discharge rollers 44 disposed at a plurality of position with appropriate intervals (see FIG. 4). That is, the restricting portions 62*b* are entirely formed in substantially sinking comb shapes.

Figure 6A:
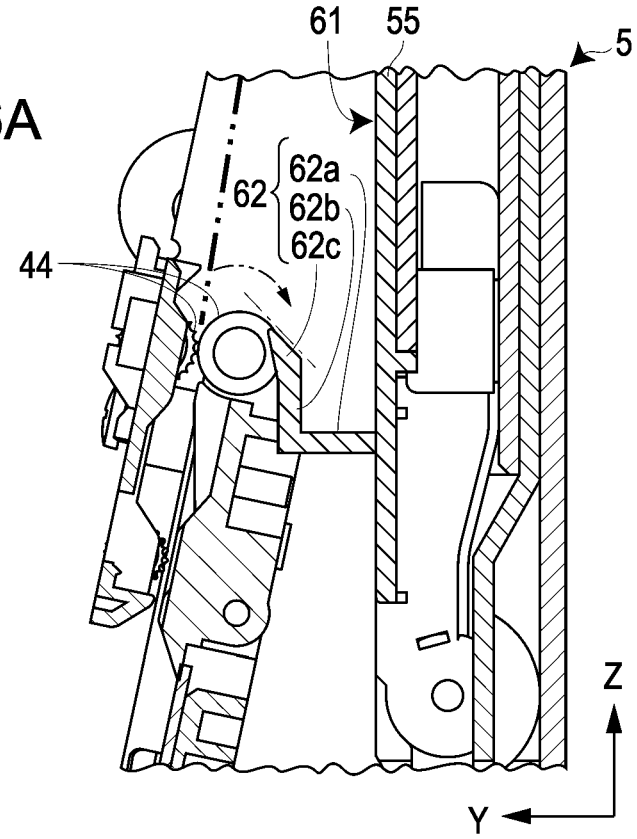
FIGS. 6A and 6B are side cross-sectional views of a receiving unit according to the first embodiment of the present invention.

Further, the inner surfaces (the surface at the holding surface 61) of the restricting portion 62*b* are positioned between the driving-side discharge roller 44 and the holding surface 61, lower than the rotary shaft of the roller 44, adjacent to the roller 44 (see FIG. 6A). Therefore, the restricting portions 62*b* do not interfere with the sheet P sent by the discharge roller 44. Further, the lower end of the sent sheet P is restricted in moving to the discharge roller 44 by the restricting portions 62*b* while being reliably supported by the supporting portion 62*a*. That is, the lower end of the sheet P is held in non-contact with the driving-side discharge roller 44. Further, the restricting portions 62*b* may be extended in the X-axial direction, similar to the supporting portion 62*a*.

A medium intake portion 62*c* formed to bend to the discharge roller 44 is disposed at the upper end of the restricting portion 62*b*. The medium intake portion 62*c* is formed such that the front end is positioned between the top of the driving-side discharge roller 44 and the rotary shaft. Further, the inner surface of the medium intake portion 62*c* (the surface at the holding surface 61) is disposed such that the line extending from the inner surface becomes a tangential line (or parallel with a tangential line) on the outer circumference of the driving-side discharge roller 44 (see one-dot chain line in FIG. 6A). The lower end of the sheet P is sent while being supported by the outer circumference of the driving-side discharge roller 44 across the top of the discharge roller 44 (see two-dot chain line in FIG. 6A) and delivered from the driving-side discharge roller 44 to the medium intake portion 62*c*. Therefore, the lower end of the sheet P appropriately and smoothly reaches the receiving unit 62 (supporting portion 62*a*).

Figure 6B:
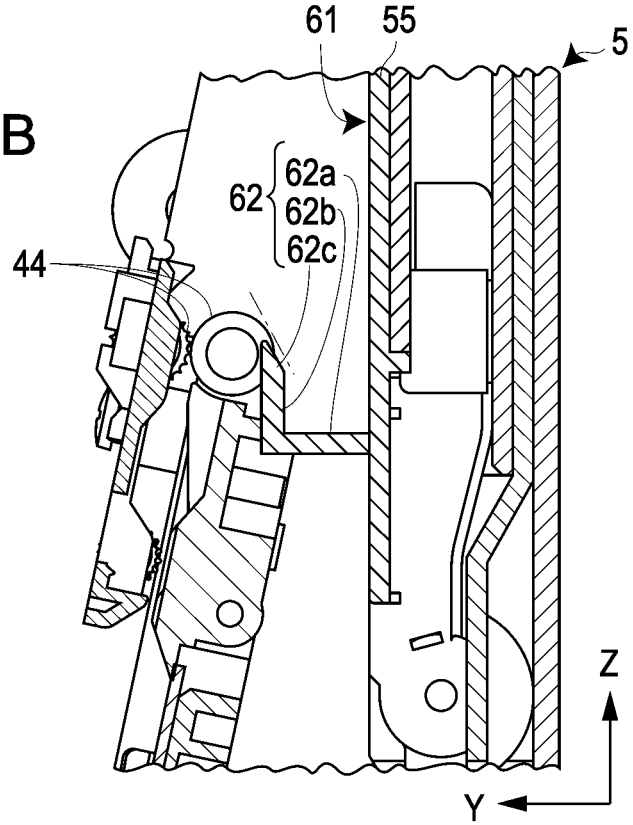

Further, as shown in FIG. 6*b*, the medium intake port 62*c* may be formed as an inclined portion that is inclined to the discharge roller 44, at the upper end of the restricting portion 62*b*.

Further, as shown in FIGS. 2 to 4, the holder 63 has a pair of pillars 63*a* protruding from both ends in the X-axial direction of the upper outer cover 55 and a plate-shaped main body 63*b* that is connected to the pair of pillars 63*a*.

The plate-shaped main body 63*b* is disposed across the sheet P in the X-axial direction, opposite to the holding surface 61 with a gap therebetween. That is, the plate-shaped main body 63*b* is spaced apart from the holding surface 61 as much as the Y-axial length of the pair of pillars 63*a*. Further, the gap between the plate-shaped main body 63*b* and the holding surface 61 may be appropriately determined by the thickness or the number of the held sheets P, but preferably, the gap is substantially the same as the gap of the sheet receiving space S that is the supply side of the sheet P.

Further, a pair of left and right curl removing rollers 64 are rotatably mounted above the plate-shaped main body 63*b*. The curl removing rollers 64 are formed in a spur shape (star wheel) and pressed against the holding surface 61.

The sheet P discharged by the pair of discharge rollers 44 is moved to the paper discharge port 24 while sliding on the holding surface 61 and the lower end of the sheet P is sent to the receiving unit 62 along the outer circumference of the driving-side discharge roller 44. Further, the lower end of the sheet P is held again in non-contact with the driving-side discharge roller 44. Further, the discharge sheet P is held in a standing posture between the holder 63 and the holding surface 61 after wrinkles (curls) are removed by the curl removing rollers 64. Therefore, the sheets are appropriately and sequentially stacked on the holding surface 61 without curling up, such that the sheets P can be continuously discharged. Further, it is possible to prevent the sheet P from being damaged when the recording medium cassette 5 is separated with the recorded sheet P curling up.

According to the configuration described above, it is possible to prevent the sheet P discharged and held after recording from coming in contact again with the driving-side discharge roller 44. Therefore, it is possible to prevent the sheet P from being contaminated or damaged, which is generated when the recorded sheet P comes in contact with the driving-side discharge roller 44. Further, as the recording medium cassette 5 is separated from the recording apparatus 1 (case 2), it is possible to supply a non-recorded sheet P and take out a recorded sheet P at one time. Further, since the recorded sheet P is held in the recording medium cassette 5, it is possible to remove a specific configuration for holding the sheet P, such that it is possible to simplify the structure and reduce the cost. Further, although the recording medium cassette 5 is applied to a so-called vertical type recording apparatus 1 in the embodiment, it may be applied to a lateral type recording apparatus 1. In this case, it is preferable to dispose the recording apparatus 1 such that the cassette case body 53 becomes the bottom.

Second Embodiment

Figure 7:
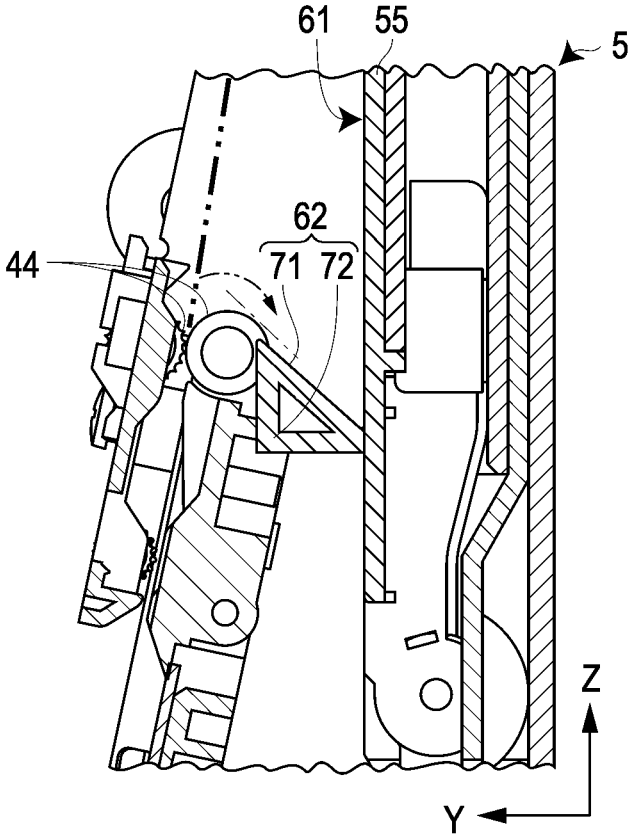
FIG. 7 is side cross-sectional view of a receiving unit according to a second embodiment of the present invention.

Next, a recording medium cassette 5 according to a second embodiment of the invention is described with reference to FIG. 7. Further, the differences from the first embodiment are described hereafter.

A receiving unit 62 of a recording medium cassette 5 according to the second embodiment has a contacting portion 71 that protrudes upward at an angle from a holding surface 61 to a discharge roller 44 and where the lower end of a sheet P comes in contact and an inclined supporting portion 72 that has an L-shape when seen from a side supporting the contact portion 71. The contact portion 71 is disposed to be inclined down toward the holding surface 61 and a right triangle is formed by the contact portion 71 and the inclined supporting portion 72 when seen from a side. Further, the contact portion 71 and the inclined supporting portion 72 are disposed at a plurality of positions with appropriate intervals in the X-axial direction and entirely form a substantially sinking comb shapes, similar to the restricting portions 62*b* of the first embodiment.

In detail, the contact portion 71 is formed such that the front end is positioned between the top of the driving-side discharge roller 44 and a rotary shaft, adjacent to the driving-side discharge roller 44. Further, the inner surface of the contact portion 71 (the surface at the holding surface 61) is disposed such that the line extending from the inner surface is parallel with a tangential line on the outer circumference of the driving-side discharge roller 44 (see one-dot chain line in FIG. 7).

The lower end of the sheet P is sent while being supported by the outer circumference of the driving-side discharge roller 44 across the top of the discharge roller (see two-dot chain line in FIG. 7) and delivered from the driving-side discharge roller 44 to the contact portion 71. The sent sheet P is moved along the inclination of the contact portion 71 by the own weight and automatically follows the holding surface 61. Further, since the inclination of the contact portion 71 is formed upward to the discharge roller 44, the contact portion 71 restricts the sheet P from moving to the discharge roller 44. Therefore, the lower end of the sheet P is held in non-contact with the driving-side discharge roller 44.

The entire disclosure of Japanese Patent Application No: 2011-017962, filed Jan. 31, 2011 is expressly incorporated by reference herein.

What is claimed is:

1. A recording apparatus comprising:

a holding unit that holds a recorded recording medium in a standing posture;

a roller that sends the recording medium to the holding unit; and a restricting unit that restricts the position of the recording medium not to be in contact with the roller;

wherein the restricting unit includes a restricting portion disposed between the roller and a vertically-oriented holding surface of the holding unit, and a medium intake portion having an angled upper surface such that the plane of the angled upper surface is substantially tangential to the outer circumference of the roller.

2. The recording apparatus according to claim 1, wherein the bottom of the holding unit is positioned vertically lower than the top of the roller.

3. The recording apparatus according to claim 1, wherein the medium intake portion is positioned vertically lower than the top of the roller.

4. The recording apparatus according to claim 1, wherein the bottom of the holding unit is disposed to decline away from the roller.

5. The recording apparatus according to claim 1, further comprising:

a recording medium cassette that is attachable to, and detachable from, a case equipped with the roller and receives the recording medium in a standing posture, wherein the holding unit is disposed in the recording medium cassette.

* * * * *